US006752085B2

(12) United States Patent
Roach

(10) Patent No.: US 6,752,085 B2
(45) Date of Patent: Jun. 22, 2004

(54) METHOD AND APPARATUS FOR RELEASABLY ATTACHING A CLOSURE PLATE TO A CASING

(75) Inventor: Eric E. Roach, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/138,300

(22) Filed: May 6, 2002

(65) Prior Publication Data

US 2003/0205161 A1 Nov. 6, 2003

(51) Int. Cl.[7] ..... F41A 9/00
(52) U.S. Cl. ..... 102/481
(58) Field of Search ..... 102/481, 351, 102/377; 285/2, 187; 403/2, 28

(56) References Cited

U.S. PATENT DOCUMENTS

| | | | | | |
|---|---|---|---|---|---|
| 3,927,791 | A | * | 12/1975 | Hershberger | 220/89.4 |
| 4,004,516 | A | * | 1/1977 | Johnson et al. | 102/499 |
| 4,025,042 | A | | 5/1977 | Doherty, Jr. et al. | |
| 4,084,512 | A | | 4/1978 | San Miguel | |
| 4,280,523 | A | * | 7/1981 | Norton | 180/250 |
| 4,411,199 | A | * | 10/1983 | Yates et al. | 102/481 |
| 4,423,683 | A | | 1/1984 | Telmo | |
| 4,727,812 | A | * | 3/1988 | Fischer et al. | 102/481 |
| 4,784,061 | A | | 11/1988 | Christopher | |
| 4,817,531 | A | | 4/1989 | Walker et al. | |
| 5,027,844 | A | * | 7/1991 | Forsythe et al. | 137/43 |
| 5,036,658 | A | * | 8/1991 | Tate | 60/253 |
| 5,155,298 | A | | 10/1992 | Koontz | |
| H1144 | H | * | 3/1993 | Cherry et al. | 60/39.1 |
| 5,311,820 | A | | 5/1994 | Ellingsen | |
| 5,315,954 | A | | 5/1994 | Richmond | |
| 5,394,803 | A | | 3/1995 | Mort | |
| 5,398,498 | A | | 3/1995 | Mort et al. | |
| 5,466,537 | A | | 11/1995 | Diede et al. | |
| 5,735,114 | A | | 4/1998 | Ellingsen | |
| 5,786,544 | A | | 7/1998 | Gill et al. | |
| 5,813,219 | A | | 9/1998 | Gill et al. | |
| 5,959,235 | A | * | 9/1999 | Wagstaff | 102/202 |
| 6,105,505 | A | | 8/2000 | Jones | |
| 6,321,656 | B1 | * | 11/2001 | Johnson | 102/377 |
| 6,338,242 | B1 | * | 1/2002 | Kim et al. | 60/204 |
| 6,479,800 | B1 | * | 11/2002 | Bueno Ruiz et al. | 219/424 |
| 2003/0051906 | A1 | * | 3/2003 | Roeters et al. | 174/260 |

* cited by examiner

*Primary Examiner*—Charles T. Jordan
*Assistant Examiner*—Jordan M Lofdahl
(74) *Attorney, Agent, or Firm*—Burns, Doane, Swecker & Mathis, L.L.P.

(57) ABSTRACT

An apparatus for releasably attaching a closure plate to an open end of a cylindrical casing, the apparatus having an inner member; a threaded outer ring biased in tension, disposed adjacent to the inner member, for releasably engaging an interior wall of the casing; and a eutectic spacer between the inner member and the outer ring. At temperatures below the melting point of the eutectic spacer, the outer ring is held in threaded engagement with the casing, and holds the closure plate in position in abutment with the casing. When the temperature of the eutectic spacer reaches its melting temperature, the eutectic spacer transitions to a liquid state, flows away from the apparatus, allowing the outer ring to retract into a groove in the inner member, and the closure to be released from the casing.

23 Claims, 5 Drawing Sheets

METHOD AND APPARATUS FOR RELEASABLY ATTACHING A CLOSURE PLATE TO A CASING

BACKGROUND

1. Field of the Invention

The present invention is directed generally to a method and apparatus for releasably attaching a closure plate to a casing.

2. Background Information

Munitions which contain explosive or incendiary material are expected to withstand various environmental situations without detonating. These stimuli are associated with hazardous situations that the munition may encounter during its life cycle. If the munition detonates severe property damage and loss of life is possible. Munitions that will not detonate when exposed to these stimuli are known as "insensitive munitions".

Munitions may be exposed to elevated temperatures, such as those encountered in a fire, during their life cycle. As the temperature of the material within the munition casing increases, the material expands and the pressure increases. At a high enough temperature and pressure the material will spontaneously combust and, if the pressure is allowed to increase further, detonate.

Munitions may also be exposed to severe localized shocks caused by ammunition, fragments from detonating munitions or from the shock wave of a nearby detonating munition. These shocks cause a localized rapid temperature and pressure increase in the material within the munition casing. As this temperature and pressure increase and propagate through the material the munition detonates.

Munitions are also often required to withstand general severe shock loads (e.g. 50,000 times the acceleration due to gravity on Earth (Gs), or lesser or greater) and still operate. As an example, penetrating warheads are designed to penetrate hard targets such as bunkers or armor without failure of the case or premature detonation.

One method for rendering munitions insensitive was stress risers, which are areas of reduced casing thickness. Stress risers have been designed so a casing will rapidly fail at a stress riser when the pressure within the casing reaches a predetermined level, lower than the pressure at which the explosive material will detonate. Because stress risers weaken the casing, they can cause the casing to fail during shock loads, such as those encountered when a munition strikes a hard target.

Some safety devices rely on venting the warhead casing when the internal pressure reaches a certain level. For example, U.S. Pat. No. 4,423,683, Telmo et al., illustrates an enclosure plate for a warhead which is designed to fail when the internal pressure reaches a predetermined value.

Other safety devices are activated by a rise in ambient temperature near the warhead. U.S. Pat. No. 4,084,512, San Miguel, illustrates a case venting system which employs thermally conductive plugs for preferentially conducting ambient heat to burn fuel located inside the casing near thin points of the casing. The fuel burns though the casing and vents the casing before the explosive material can detonate. U.S. Pat. Nos. 5,786,544 and 5,813,219, both to Gill et al., use a venting device and pyrotechnic pellets which ignite at a desired temperature to non-explosively burn the propellant within the rocket motor of a warhead. U.S. Pat. No. 5,466,537, Diede et al., illustrates an intermetallic thermal sensor for use in venting or mitigation systems.

Some designs incorporate materials which melt at a desired ambient temperature. U.S. Pat. Nos. 5,311,820 and 5,735,114, Ellingsen, provide an interface between a case and closure or nozzle which is designed to release at a temperature lower than the auto-ignition temperature of the propellant contained within a rocket motor. U.S. Pat. Nos. 5,394,803, and 5,398,498, both to Mort, illustrate joint constructions for use between a rocket motor and a warhead which separate when subjected to high temperatures. U.S. Pat. No. 5,155,298, to Koontz, illustrates another safety apparatus for venting a warhead in high temperature environments, which uses a eutectic solder to hold a snap ring in place. All the references in the above paragraphs are incorporated herein by reference in their entireties.

Systems which incorporate materials which melt at a desired ambient temperature typically have numerous complex parts, resulting in high production costs and complex assembly methods. Further, these designs generally lack strength sufficient to withstand shock loads encountered by penetrating warheads during impact. In addition, these systems typically require significant redesign of current warhead casings.

Accordingly, it is an object of the invention to provide an apparatus which releases pressure within a warhead casing when exposed to a heat source, and which can withstand shock loads.

SUMMARY OF THE INVENTION

Exemplary embodiments of the present invention are directed to providing an apparatus for releasably attaching a closure plate to an open end of a cylindrical casing, comprising an inner member; a threaded outer ring biased in tension, disposed adjacent to the inner member, for releasably engaging an interior wall of the casing; and a eutectic spacer between the inner member and the outer ring.

Exemplary embodiments of the invention are also directed to a method for assembling an apparatus for releasably attaching a closure plate to a casing, with a inner member sized to fit within a hollow cylindrical casing, the inner member having a groove formed on an outer peripheral surface of the inner member, and an outer ring sized to fit within the groove of the inner member, the outer ring having two ends and a threaded outer peripheral surface. The method includes: positioning the outer ring in an expanded position partially within the groove of the inner member; and forming a eutectic spacer in an annular space defined by a surface of the outer ring in an expanded position and a surface of the inner member by filling the annular space with a liquid eutectic material, and cooling the liquid eutectic material to form a solid eutectic spacer while the outer ring is held in an expanded position.

Exemplary embodiments of the invention are also directed to a method for releasably attaching a closure plate to a casing with an apparatus having an inner member, an externally threaded outer ring biased in tension, disposed adjacent to the inner member for releasably engaging an interior wall of the casing, a eutectic spacer between the inner member and the outer ring, and bleed means for releasing the eutectic spacer when in a melted state. The method includes fitting the closure plate within an opening in an open end of a cylindrical casing so the closure plate abuts an internal surface of the cylindrical casing; and threading the apparatus into the cylindrical casing so the external threads of the outer ring engage internal threads of the cylindrical casing, wherein the apparatus holds the closure place in contact with the casing.

BRIEF DESCRIPTION OF THE DRAWING FIGURES

Other objects and advantages of the invention will become apparent from the following detailed description of preferred embodiments in connection with the accompanying drawings in which like numerals designate like elements and in which.

Figures 3A, 3B, 3C, 3D:
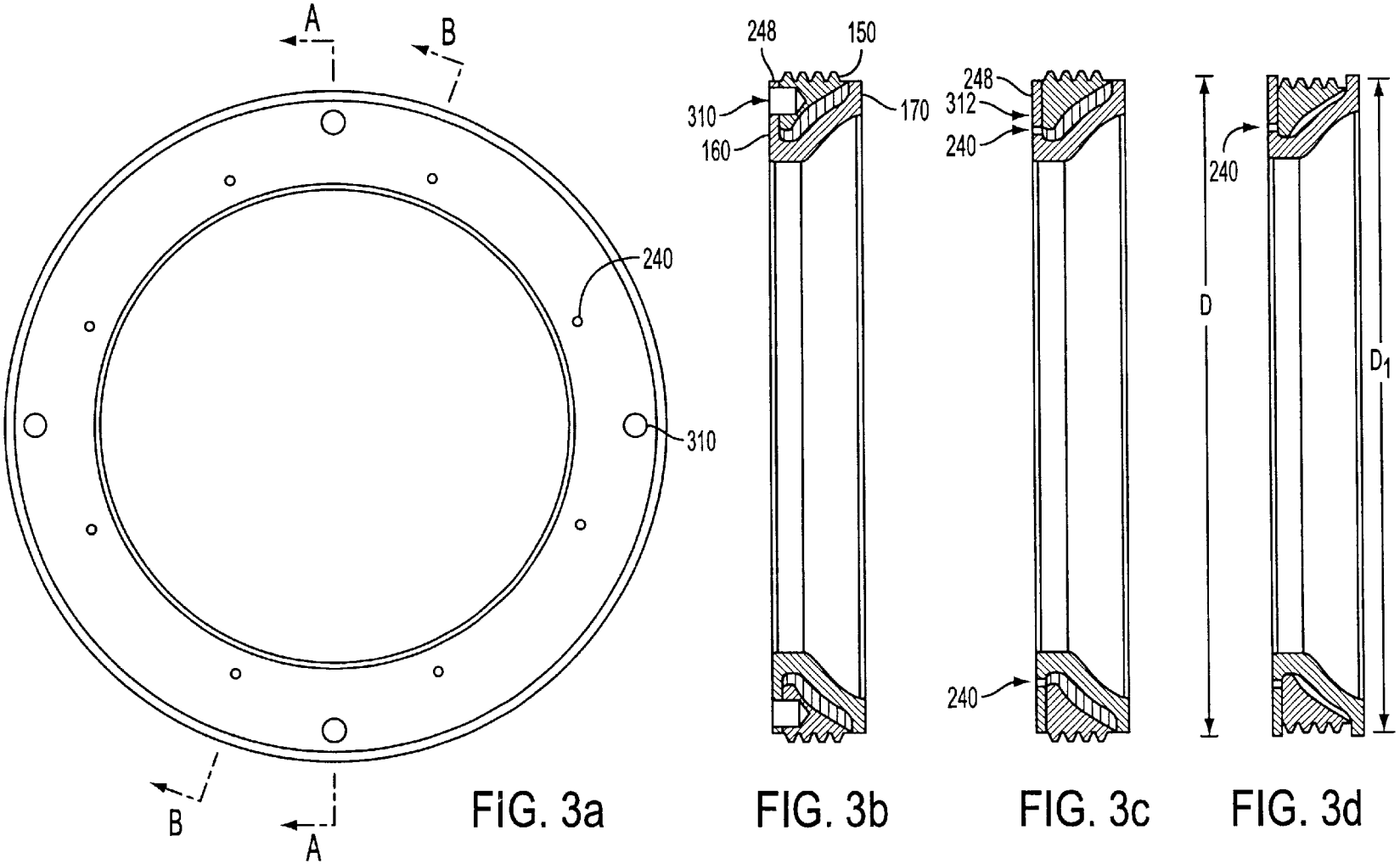

FIG. 3*a* is an end view an exemplary apparatus for releasably attaching a closure plate to a casing in accordance with an exemplary embodiment of the invention.

FIG. 3*b* is a cross sectional view of an exemplary apparatus corresponding to A—A of FIG. 3*a*.

FIGS. 3*c* and 3*d* are cross sectional views of an exemplary apparatus corresponding to B—B of FIG. 3*a* with the outer ring of the apparatus in an expanded and a retracted position, respectively.

Figures 4, 5:
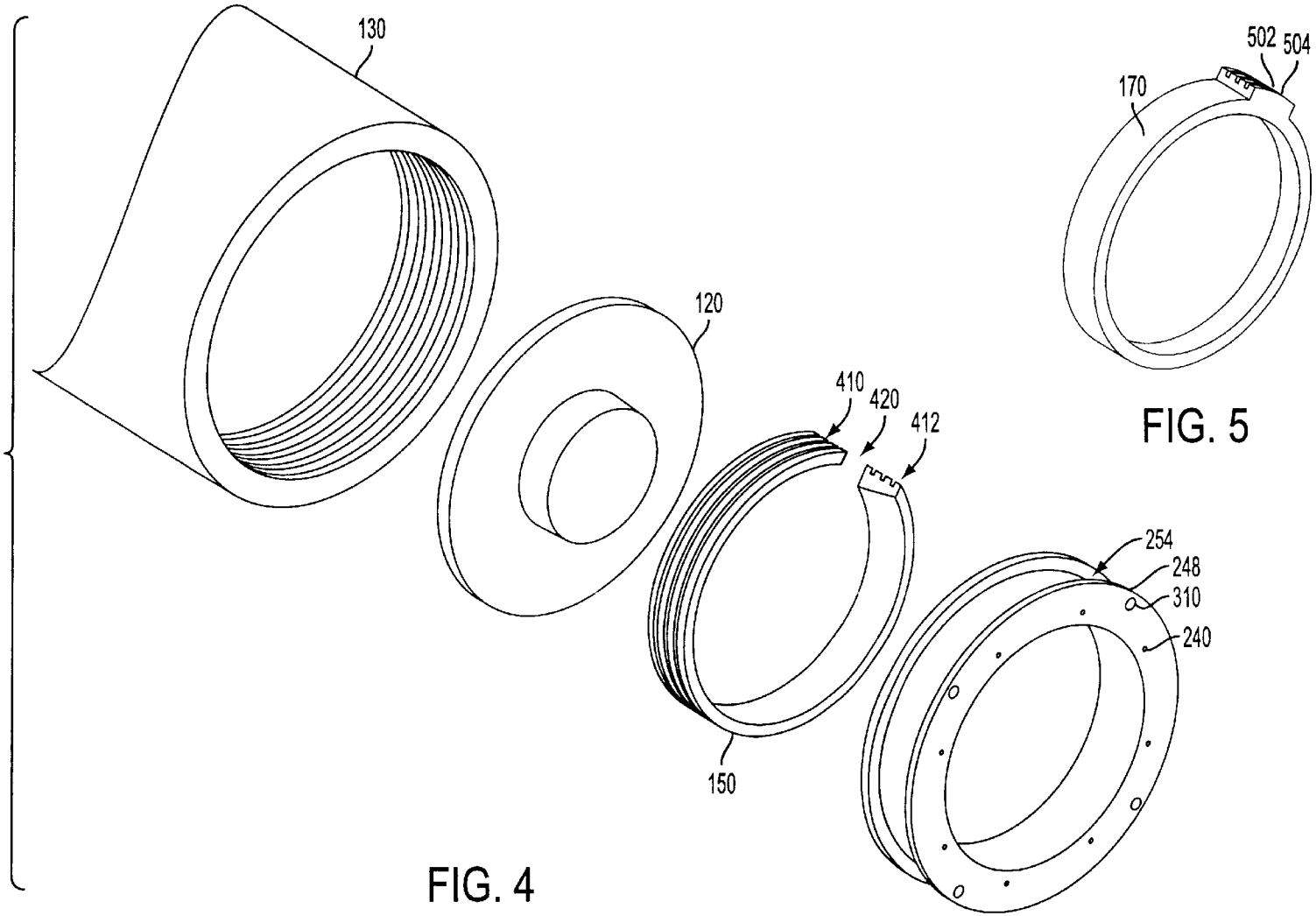

FIG. 4 is an expanded view of a casing and a closure plate together with an apparatus for releasably attaching the closure plate to the casing in accordance with an exemplary embodiment of the invention.

FIG. 5 is a view of an exemplary eutectic spacer for use in an embodiment of the invention.

Figure 6:
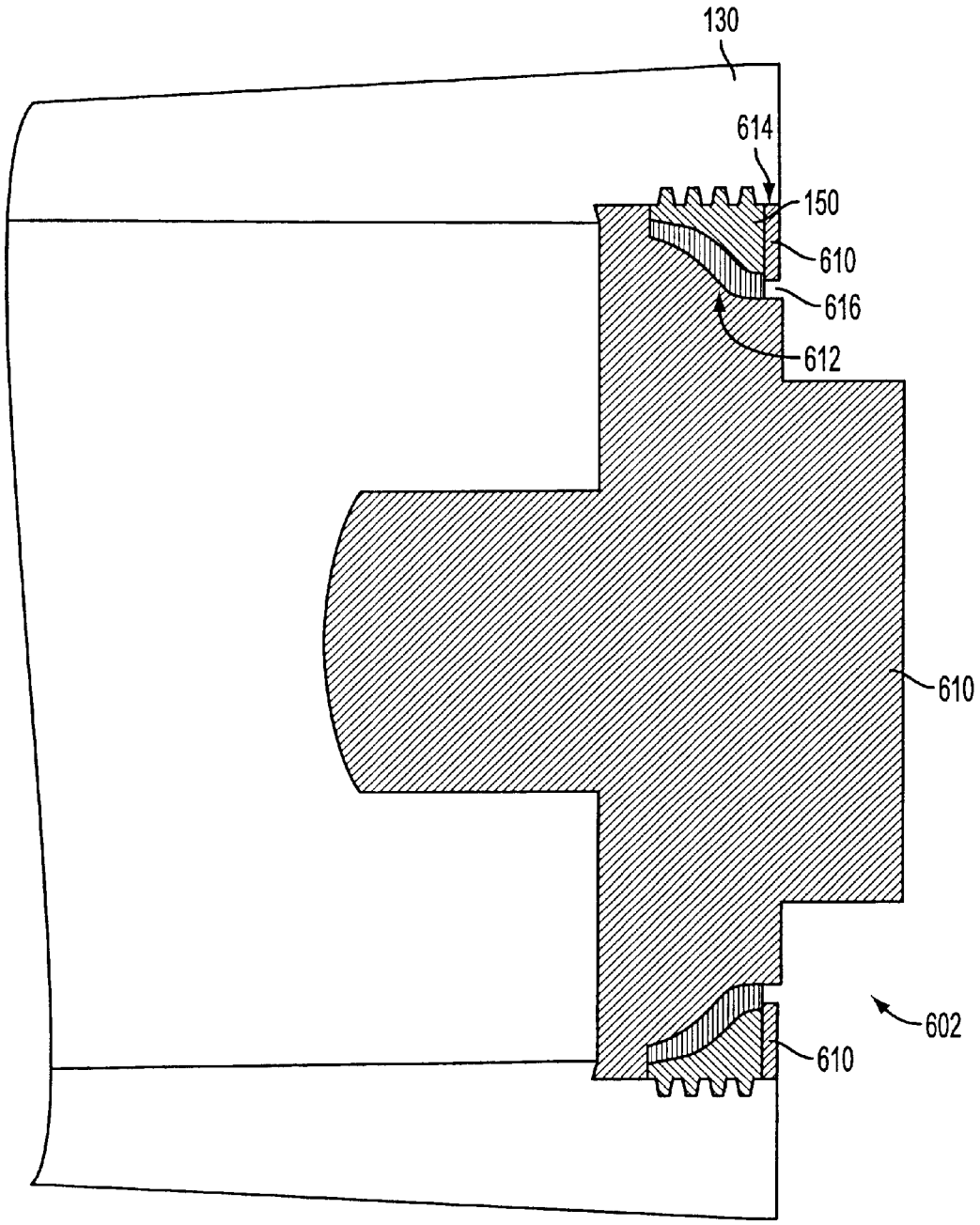

FIG. 6 is an exemplary cross sectional view of another exemplary embodiment of an apparatus for releasably attaching a closure plate to a casing.

DETAILED DESCRIPTION OF THE PREFERRED EMBODIMENTS

Figure 1:
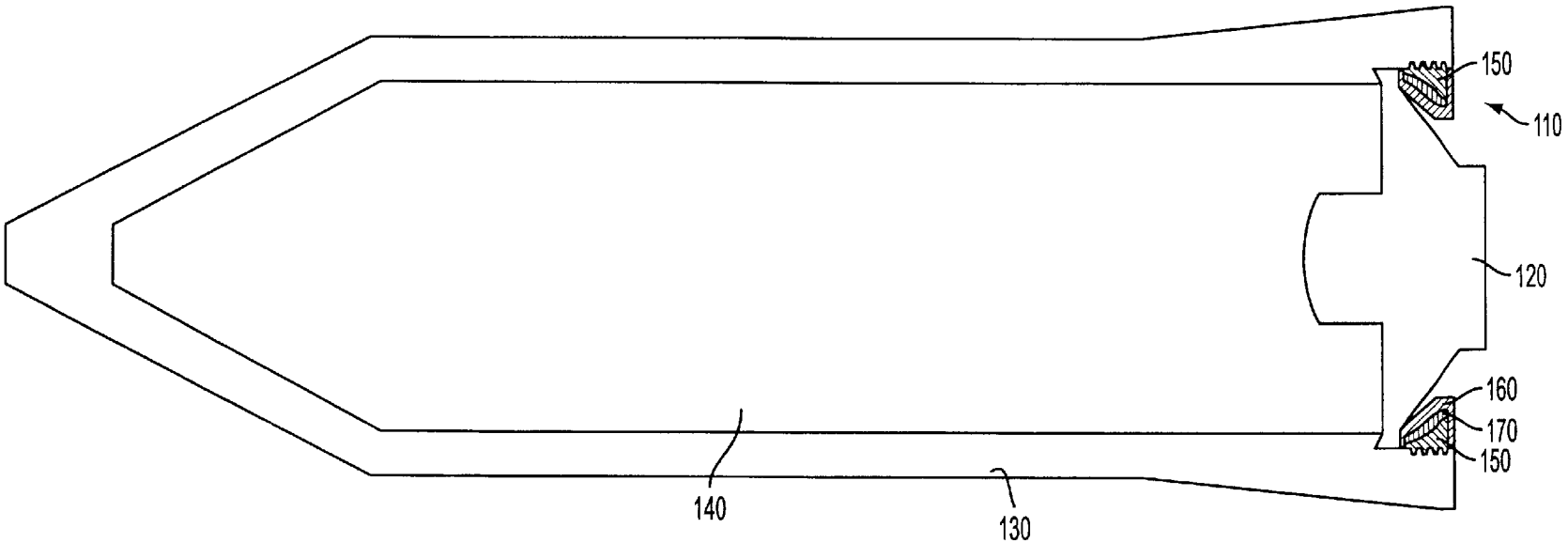
FIG. 1 is a cross-sectional schematic of an exemplary apparatus for releasably attaching a closure plate to a casing in accordance with an embodiment of the invention threadably engaging a casing.

FIG. 1 illustrates an exemplary embodiment of an apparatus 110 for releasably attaching a closure plate 120 to a casing 130. The casing 130 can be a component of a bomb or warhead or other device, and can be cylindrical with an open end. The casing 130 can contain any type of material 140, including but not limited to incendiary or explosive material. The closure plate 120 can be any structure suitable to be held against an open end of the casing 130, such as, for example, a metal plate or a propellant nozzle. At high temperatures, the apparatus 110 disengages from the casing 130 so the closure plate 120 can fall away from the casing or be pushed away from the casing by the pressure within the casing 130.

The apparatus 110 includes an inner member 160, shown in FIG. 1, disposed adjacent to the closure plate 120. The apparatus 110 also includes a threaded outer ring 150 biased in tension, disposed adjacent to the inner member 160, for releasably engaging an interior wall of the casing, and a eutectic spacer 170 between the inner member 160 and the threaded outer ring 150.

The inner member 160 can be any type of structure suitable for holding the closure plate 120 against the casing 130, with a eutectic spacer and a threaded outer ring radially between the inner member and the casing 130. In the exemplary embodiment of FIG. 1, the inner member 160 is a ring. In alternative embodiments, the inner member 160 can be the closure plate itself.

Figure 2:
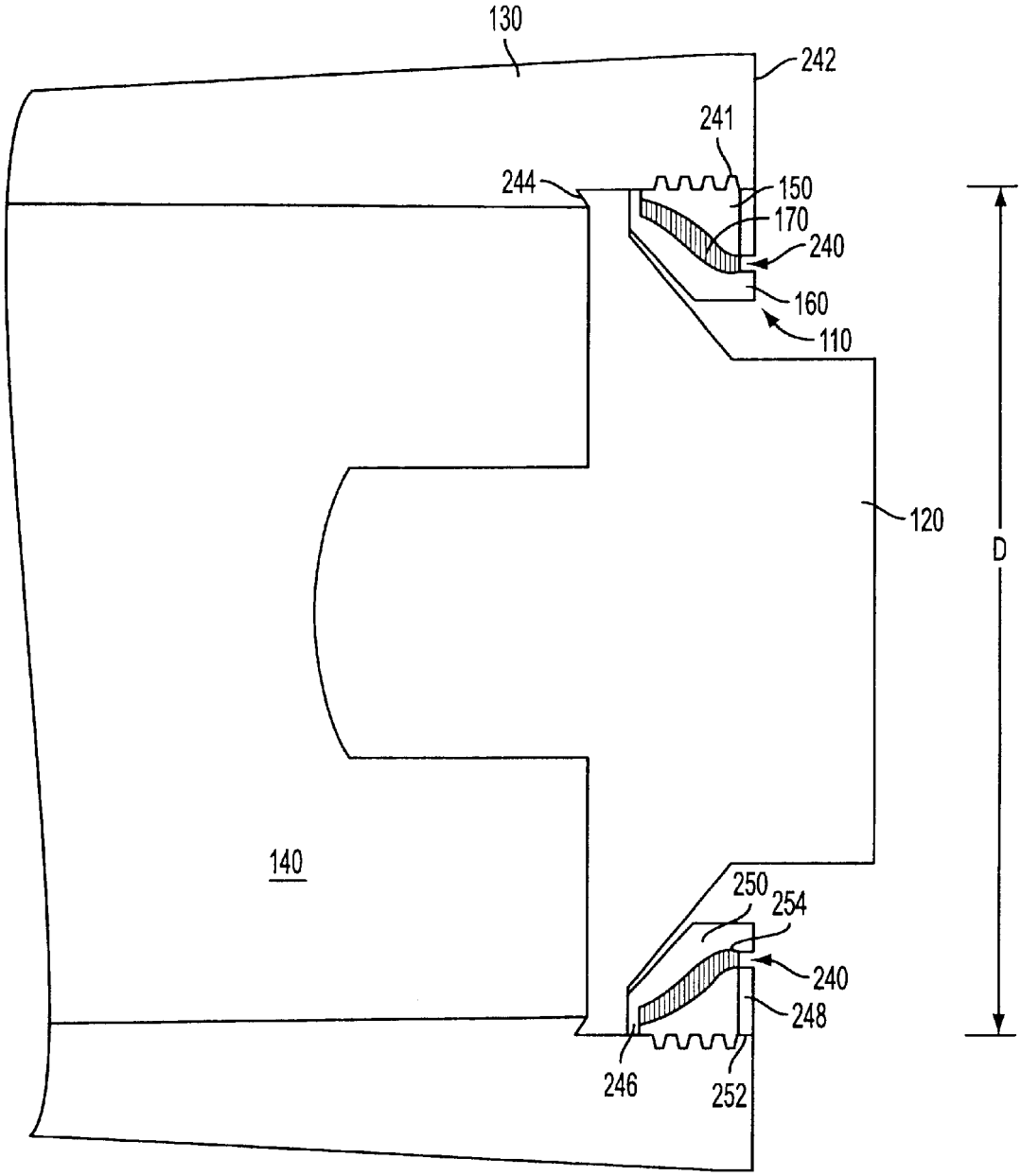
FIG. 2 is a cross sectional schematic of an apparatus for releasably attaching a closure plate to a casing in accordance with an exemplary embodiment of the invention.

FIG. 2 illustrates an exemplary embodiment of the apparatus 110 threadably engaged with the interior threaded surface 241 of the inner wall of the casing 130, and holding the closure plate 120 against the casing 130. The closure plate 120 is shown abutting a shoulder 244 of the casing 130. The inner member 160, is ring-shaped, with a groove 254 formed in an outer peripheral surface 252. The groove 254 is defined by a first radially extending portion 246 of the inner member 160, a second radially extending inner member 160, although many other configurations readily recognized by those skilled in the art are possible within the scope of the invention.

The outer ring 150 is threaded on its outer peripheral surface, with external threads intended to match the internal threads of the inner wall of a casing 130. In an exemplary embodiment, the external threads of the outer ring 150 are helical screw type threads with a profile described as ACME-2G, and the major (outer) diameter of the screw threads is 10.5 inches when the outer ring is in an expanded position. A corrosion preventive compound can be applied to the threads. An example of a suitable corrosion preventive compound is described in military standard MIL-C-16173, grade 4, incorporated herein in its entirety.

The outer ring 150 is sized to fit partially within the groove 254 in the inner member 160 when a eutectic spacer 170 fills the annular space formed by the outer ring 150 in its expanded position and the inner member 160. The outer ring 150 is biased in tension in an outward radial direction by the presence of the eutectic spacer 170, so that the outer ring 150 has tendency to retract radially inward if the eutectic spacer 170 is not present. The outer ring 150 is sized to retract into the groove 254 in the inner member 160 when the eutectic spacer 170 is removed.

The eutectic spacer 170 is formed of a eutectic material which is a solid at temperatures below a predetermined melting temperature, and which is a liquid at temperatures above a predetermined melting temperature. In an exemplary embodiment, the eutectic spacer 170 is a eutectic metal alloy. In another exemplary embodiment, the eutectic spacer 170 has a melting point below that of the casing 130 and the closure plate 120. In another exemplary embodiment, the eutectic spacer 170 is a tin bismuth alloy having approximately 42% tin and 58% bismuth, and a melting temperature of about 138 C (281° F.). The material which forms the eutectic spacer 170 can be a commercially available eutectic solder, designated Sn42Bi58 as defined in Federal Specification, Solder, Electronic (96 to 485 C) QQ-S-571F, incorporated herein in its entirety. Of course, various eutectic alloys may be used, depending on the desired melting temperature. The term eutectic alloy also includes slightly hypo-eutectic or hyper-eutectic alloys which are sufficiently liquid to escape from between the inner member 160 and the outer ring 150 when the temperature reaches a desired temperature.

The eutectic spacer 170 can be formed by filling the annular space between the inner member 160 and the outer ring 150 with the eutectic material in its liquid state, while the outer ring 150 is held in an expanded position, then allowing the eutectic material to cool to form the solid eutectic spacer 170.

The apparatus 110 can also include bleed means for releasing the eutectic spacer 170 when in a melted state. The bleed means can be any conduit through which the eutectic material can escape. In the exemplary embodiment illustrated in FIG. 2, the bleed means includes at least one bleed hole 240 in the inner member 160. The bleed hole 240 extends from a surface of the inner member 160 in contact with the eutectic spacer 170 to an outer surface of the inner member 160.

In the exemplary embodiment shown in FIGS. 3*a*–3*d*, the bleed means comprises eight 0.18 inch diameter bleed holes formed in the inner member 160. FIGS. 3*b* and 3*c* illustrate the outer ring 150 in an expanded position, with the solid eutectic spacer 170 between the outer ring 150 and the inner member 160. The bleed holes 310 extend through the inner member 160 so the melted eutectic material can exit. As shown in FIG. 3*c*, bleed holes are formed in the second radially extending portion 248 of the inner member 160 and extend from the groove 254 holding the eutectic spacer 170 to an outer surface 312 of the inner member 160. In the expanded position shown in FIGS. 3*a* and 2*b*, the external threads of the outer ring 150 extend beyond the outer diameter of the inner member 160 in a radial direction so the external threads can engage the interior threads of the inner wall of the casing 130.

FIG. 3*d* illustrates the retracted position of the outer ring 150 in the groove 254 after the eutectic spacer 170 in a liquid state has exited through the bleed holes 240. In an exemplary embodiment, in its retracted position, the major (outer) diameter $D_1$ of the outer ring 150 is smaller than major (inner) diameter D of the inner wall of the casing 130, which allows the apparatus 110 to fall from or be ejected from the open end of the casing 130.

In the exemplary embodiment illustrated in FIG. 4, the outer ring 150 has two ends 410, 412 which define an opening 420 in the outer ring 150. When no force is exerted on the outer ring 150, the ends 410, 412 can abut each other, or can be spaced some angular distance away from each other. The outer ring 150 is sized so that to place it in the groove 254 of the inner member 160, the ends 410, 412 of outer ring must be separated from each other, thus radially expanding the outer ring 150.

The opening 420 defined by the ends 410, 412 of the outer ring 150 in an expanded position and the groove 254 is a convenient opening though which the liquid eutectic spacer can be introduced to the annular space between the inner member 160 and the outer ring 150. The opening 420 is also filled with the liquid eutectic material. In the exemplary embodiment shown in FIG. 5, the eutectic spacer 170 in its solid form has a arcuate section 502 which fills the opening 420 between the two ends 410, 412 and helps maintain the outer ring 150 in its expanded position. In an exemplary embodiment, external threads 504 are machined into the outer peripheral surface of the arcuate section 502. The threads 504 have the same profile as and are continuous with the external threads on the outer peripheral surface of the outer ring 150, so the apparatus 110 can easily be threaded into the casing 130.

The apparatus 110 can also include holding means for holding the outer ring 150 in an expanded position while liquid eutectic material is being added. The holding means can hold the outer ring 150 in place until the temperature of the liquid eutectic material drops sufficiently to form a solid eutectic spacer 170. The holding means may be any type of device which maintains the outer ring 150 in its expanded position until the eutectic material has formed a solid eutectic spacer 170. As shown in FIGS. 3*a* and 3*b*, the holding means can include four tooling holes 310 which extend through a second radially extending portion 248 of the inner member 160 and which extend into the outer ring 150. The tooling holes 310 in the inner member 160 and outer ring 150 are axially aligned with each other when the outer ring 150 is in an expanded position. In another exemplary embodiment (not shown), the tooling holes 310 can extend through the outer ring 150 to the space between the outer ring 150 and the inner member 160 so the tooling holes can also act as bleed means through which the liquid eutectic material may escape.

A fixture (not shown) with projections which correspond to and fit within the tooling holes 310 and to the bleed holes 240 can be used during assembly of the apparatus 110. The projections corresponding to the tooling holes will hold the outer ring 150 in position while the eutectic material is added and while the eutectic material cools to form a solid eutectic spacer 170. The projections which correspond to the bleed holes 240 prevent the liquid eutectic material from escaping from the apparatus 110. After the eutectic material has cooled to form a solid eutectic spacer 170, the apparatus 110 can be removed from the fixture.

An exemplary embodiment of the invention includes a method for assembling an apparatus for releasably attaching a closure plate to a cylindrical casing. The outer ring 150 is expanded in the radial direction by moving the ends 410, 412 of the outer ring 150 away from each other, and the outer ring 150 is moved over the outer peripheral surface of the inner member 160 until it is aligned with the groove 254 of the inner member 160. The bleed holes 240 are covered so no leakage of eutectic solder will occur. The outer ring 150 is held in its expanded position by use of holding means. Liquid eutectic material is allowed to flow into and fill the space between the groove 254 in the inner member 160 and the outer ring 150, and the opening 420 between the ends 410, 412 of the outer ring 150, forming a solid eutectic spacer 170 with an arcuate section 502 extending radially outward from a centerline of the apparatus. The apparatus 110 is cooled to allow the eutectic solder to solidify and form a solid eutectic spacer. Once the eutectic spacer 170 is solid, the bleed holes 240 can be uncovered and the outer ring 150 can be released. In an exemplary embodiment, the outer surface of the arcuate segment 502 of the eutectic spacer 170 is machined to form threads which are continuous with the threads of the outer ring 150.

The method described above forms an apparatus 110 which can easily be transported and stored as a unit. The apparatus 110 can also easily be attached to a casing 130 without complex attachment devices, by screwing the threads of the apparatus 110 into matching threads on an inner surface of a cylindrical casing 130.

An exemplary embodiment of the invention includes a method for releasably attaching a closure plate to a cylindrical casing. The method includes fitting the closure plate within an opening in an open end of the cylindrical casing so the closure plate abuts an internal surface of the cylindrical casing, and threading the apparatus into the cylindrical casing so the external threads of the outer ring engage internal threads of the cylindrical casing. The apparatus includes an externally threaded outer ring biased in tension disposed adjacent to an inner member, for releasably engaging an interior wall of the cylindrical casing, bleed means for releasing the eutectic spacer when in a melted state, and a eutectic spacer located between the inner member and the outer ring. The apparatus holds the closure plate in contact with the casing. The inner member can be either an inner ring disposed against the closure plate, or can be the closure plate itself.

In an exemplary embodiment, the closure plate 120 abuts a shoulder 244 or other structure within the casing 130. In an exemplary embodiment, the apparatus 110 is threaded into the open end of the casing 130, so the exterior threads on the outer ring 150 and on the arcuate section 502 of the eutectic spacer 170 engage internal threads of the inner wall of the casing 130. In an exemplary embodiment, at least 3½ threads are engaged with the casing threads.

Additional torque may be applied to ensure vibration or other environmental effects do not loosen the apparatus 110 from the casing 130. When threadably engaged with the casing 130, the apparatus 110 can only be released from the casing 130 by applying an opposing torque sufficient to loosen the threads, or by raising the temperature of the eutectic spacer 170 enough to transform the eutectic spacer 170 into a liquid material which will bleed out of the apparatus 110. The apparatus 110 in combination with a closure plate 120 and a casing 130 is thus very resistant to even extreme shock loads.

In another exemplary embodiment illustrated in FIG. 6, the apparatus 602 includes an inner member 610 which is the closure plate. A groove 612 is formed directly in the outer peripheral surface 614 of the closure plate 610 for receiving the outer ring 150 and the eutectic spacer 170. Forming the groove 612 for the spacer 170 and the outer ring 150 directly in a closure plate eliminates the need for a separate inner member 160 of previously discussed embodiments. The outer ring 150 and eutectic spacer 170 are assembled into an apparatus with the inner member 610 as in the previously discussed embodiments. The apparatus 602 can also include bleed means 616 and holding means (not shown) similar to the previously discussed embodiments.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. An apparatus for releasably attaching a closure plate to an open end of a cylindrical casing, comprising:

an inner member;

a threaded outer ring having threads biased in tension, the threaded outer ring disposed adjacent to the inner member, said threads releasably engaging an interior wall of the casing; and a eutectic spacer between the inner member and the outer ring.

2. An apparatus as in claim 1, wherein the inner member has an outer peripheral surface and a groove formed in the outer peripheral surface for holding a eutectic spacer and a portion of the outer ring.

3. An apparatus as in claim 1, wherein the inner member has a first radially extending portion, a second radially extending portion, and an axially extending central portion between the first radially extending portion and the second radially extending portion; the first radially extending portion, second radially extending portion and axially extending central portion defining a groove in an outer peripheral surface of the inner member, the eutectic spacer and the outer ring being at least partially located in the groove.

4. An apparatus as in claim 1, wherein the inner member is an inner ring disposed adjacent to the closure plate.

5. An apparatus as in claim 1, wherein the inner member is the closure plate.

6. An apparatus as in claim 1, wherein the outer ring has an outer peripheral surface, and the threads are external threads disposed on the outer peripheral surface sized to match a threaded surface on an inside wall of the casing.

7. An apparatus as in claim 6, wherein the external threads are helical screw-type threads.

8. An apparatus as in claim 1, wherein the eutectic spacer has a melting point below that of an inner ring and the outer ring.

9. An apparatus as in claim 1, wherein the eutectic spacer is disposed within a groove and the outer ring is at least partially within the groove.

10. An apparatus as in claim 1, wherein the eutectic spacer comprises:

a metal alloy.

11. An apparatus as in claim 10, wherein the metal alloy comprises:

a tin bismuth alloy.

12. An apparatus as in claim 11, wherein the metal alloy comprises:

an alloy having about 42 percent tin and 58 percent bismuth by weight.

13. An apparatus as in claim 1, wherein the eutectic spacer has a melting temperature of about 281 degrees Fahrenheit.

14. An apparatus as in claim 1, comprising:

bleed means for releasing the eutectic spacer when in a melted state.

15. An apparatus as in claim 14, wherein the bleed means comprise:

at least one hole in the inner member, the hole extending from a first surface of the inner member in contact with the eutectic spacer to a second surface of the inner member.

16. An apparatus as in claim 1, further comprising:

holding means for holding the outer ring in an expanded position while a liquid eutectic material is added to a space between the outer ring and the inner member.

17. An apparatus as in claim 16 wherein the holding means comprise:

at least one tooling hole formed in the apparatus having a portion which extends through an axially extending portion of the inner member, and a portion which extends into the outer ring;

wherein the portion of the tooling hole extending through a radially extending portion of the inner member and the portion of the tooling hole extending through the outer ring are axially aligned when the outer ring is in an expanded position.

18. An apparatus as in claim 1, in combination with an open end of a cylindrical casing.

19. An apparatus as in claim 1 in combination with a closure plate and an open end of a cylindrical casing.

20. A method for assembling an apparatus for releasably attaching a closure plate to a cylindrical casing wherein an inner member is sized to fit within a hollow cylindrical casing, the inner member having a groove formed on an outer peripheral surface of the inner member; and an outer ring is sized to fit within the groove of the inner member, the outer ring having two ends and a threaded outer peripheral surface, the method comprising:

positioning the outer ring partially within the groove of the inner member; and forming a eutectic spacer in an annular space defined by a surface of the outer ring in an expanded position and a surface of the inner member by filling the annular space with a liquid eutectic material, and cooling the liquid eutectic material to form a solid eutectic spacer while the outer ring is held in an expanded position.

21. A method as in claim 20 comprising:

filling an opening formed by two ends of the outer ring and by a surface of the inner member with liquid eutectic material to form the solid eutectic spacer, wherein the solid eutectic spacer has an arcuate section extending radially outward to the outer peripheral surface of the outer ring.

22. A method as in claim 21, further comprising:

forming external threads on the outer peripheral surface of the arcuate section of the solid eutectic spacer.

23. A method for releasably attaching a closure plate to a cylindrical casing with an apparatus including an externally threaded outer ring, biased in tension, disposed adjacent to an inner member for releasably engaging an interior wall of the cylindrical casing, and bleed means for releasing a eutectic spacer when in a melted state, and wherein the eutectic spacer is located between the inner member and the outer ring, the method comprising:

fitting the closure plate within an opening in an open end of the cylindrical casing so the closure plate abuts an internal surface of the cylindrical casing; and threading the apparatus into the cylindrical casing so the external threads of the outer ring engage internal threads of the cylindrical casing, wherein the apparatus holds the closure plate in contact with the casing.

* * * * *